United States Patent [19]

Thomson

[11] 4,089,138

[45] May 16, 1978

[54] BLAST CLEANING APPARATUS

[76] Inventor: James Farquhar Thomson, Low House Farm, Timble, Otley, Yorkshire, England

[21] Appl. No.: 764,504

[22] Filed: Feb. 1, 1977

[51] Int. Cl.[2] ..... B24C 3/26

[52] U.S. Cl. ..... 51/422; 241/171

[58] Field of Search ..... 51/422, 423, 163.2, 51/164; 241/171

[56] References Cited

U.S. PATENT DOCUMENTS

| | | | |
|---|---|---|---|
| 1,656,238 | 1/1928 | Ruemelm | 51/423 |
| 2,540,358 | 2/1951 | Symons | 241/171 X |
| 3,643,380 | 2/1972 | Thomson | 51/422 |

*Primary Examiner*—Gary L. Smith

*Attorney, Agent, or Firm*—Fred Philpitt

[57] ABSTRACT

Shot blasting apparatus comprising a blasting chamber, a rotatable drum in the chamber for holding articles to be shot blasted, and means below the level of the drum to raise and lower the drum to enable articles which have been shot blasted to leave the apparatus.

1 Claim, 1 Drawing Figure

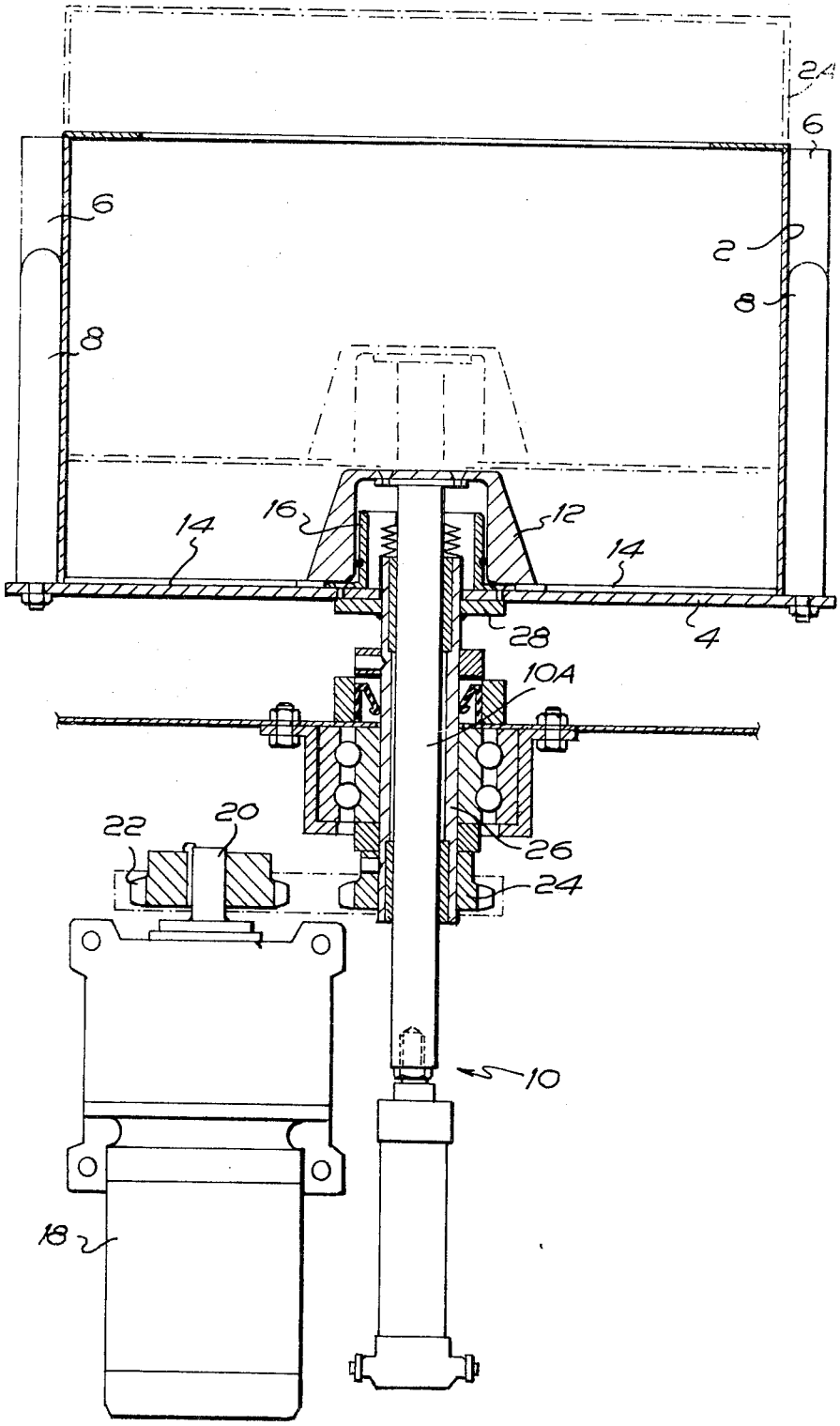
2A
6
6
2
8
8
16
12
14
14
28
4
10A
22
20
26
24
10
18

BLAST CLEANING APPARATUS

This invention relates to apparatus for the blast treatment of articles, and is a modification of the invention described and claimed in U.S. Pat. No. 3,643,380.

In said U.S. Pat. No. 3,643,380 there is described and claimed apparatus for blast treating articles with abrasive or non-abrasive material, comprising an enclosed cabinet or casing having means for supporting and rotating a detachable perforated drum or basket about an axis inclined to a vertical plane, an access door in the cabinet or casing for insertion into the drum of articles to be treated, and means for projecting treatment material into the drum or basket during its rotation, the perforated drum or basket being rotatable with but separable from an inclined plate which forms the bottom of the drum or basket, the drum or basket being movable by power-operated means in a direction substantially normal to the disposition of the plate, whereby movement of the basket or drum in the said direction permits articles on said plate to leave said plate and said apparatus.

The power-operated means for moving the basket or drum, according to said U.S. Pat. No. 3,643,380 comprises a pneumatic piston-and-cylinder arrangement, which through the intermediary of a cross-head and a stirrup associated with the upper end of the drum or basket, is adapted to raise and lower the drum or basket relative to the plate.

Thus the drum or basket is moved from above, and whilst this has been found to be satisfactory in use, it does add to the production cost of the apparatus in the provision of the cross head, stirrup and allied equipment.

According to the present invention, it is proposed to raise the drum or basket clear of the plate, on which the articles lie, from below said plate by means of poweroperated means located below said plate and secured or attached to a portion of said drum.

In order that the invention may be more readily understood, an embodiment thereof will now be described, by way of example, reference being made to the accompanying drawing, the single FIGURE of which is a cross-sectional elevation through part of the apparatus according to the invention.

Referring to the drawing, there is shown a basket or drum 2 which is shown in the drawing as resting on a plate 4 and which is capable of being raised to its phantom-line position as indicated by reference numeral 2A. The basket or drum 2 is in essence the same as that shown and described in the patent referred to above in that the basket or drum is provided with recesses 6 which are engaged by guide rods 8 carried by the plate 4, the guide rods serving to retain the basket or drum in position on the plate and to act as guides during the raising and lowering of the basket or drum 2.

The basket or drum 2 is movable towards and away from the plate 4 by means of a pneumatic piston-and-cylinder arrangement 10, the piston 10A of which is secured to a hub 12 carried by spokes 14 of the basket as drum 2. The hub 12 is guided by a guide means 16 secured to the plate 4.

The basket or drum 2 is rotatable with the plate 4 by means of an electric motor 18, the output shaft 20 of which carries a toothed wheel 22 which through the intermediary of a toothed wheel 24 carried by a sleeve 26 enclosing part of the piston 10A and secured to the plate 4 by a support plate 28, is adapted to cause rotation of the plate 4. Bearings 30 are provided for the sleeve 26, together with appropriate seals for the various parts of the apparatus.

In operation and assuming the plate 4, basket or drum 2 and allied equipment to be included with respect to a vertical axis (somewhat as shown in the drawing of the above referred to Patent), in order to release articles (not shown) from the drum or basket, the piston-and-cylinder arrangement 10 is actuated to raise the basket or drum clear of the plate 4 thus enabling the said articles to slide from the plate. It will be appreciated that, if desired, the basket or drum 2 may be raised and lowered during rotation of the plate and drum.

Apparatus according to the invention will, as will be appreciated, include the customary blasting guns, media supply pipes and nozzles, and the apparatus may include means for supporting the blasting media from flash, etc., removed from articles being treated, together with means for the separation of flash, and means for the recirculation of the blasting media and the removal from the apparatus of the flash.

It will be appreciated that whilst the invention is applicable to apparatus in accordance with U.S. Pat. No. 3,643,380 it is equally applicable to apparatus where the plate is not inclined i.e. where the plate forming the bottom of the drum or basket is substantially horizontal.

I claim:

1. An apparatus for containing and rotating articles so that they can be treated with a blasting material, said apparatus, including:

(a) a perforated drum having a bottom that includes a hub and a plurality of spaced apart spokes extending outwardly therefrom, (b) a plate which is parallel to the bottom of said drum but which is separate from said drum, (c) means for moving said perforated drum towards and away from said plate in a direction substantially normal to said plate, said means being located beneath said plate and including a piston and cylinder means, the piston of which has one end attached to said hub and extends through the center of said plate, (d) a sleeve enclosing part of the piston of said piston-and-cylinder arrangement, said sleeve carrying a first toothed wheel, and (d) means for rotating both said perforated drum and said plate, said means including an electric motor having an output shaft which carries a second toothed wheel that is positioned to engage said first toothed wheel on said sleeve.

* * * * *